US006149041A

United States Patent [19]

Perino et al.

[11] Patent Number: 6,149,041

[45] Date of Patent: Nov. 21, 2000

[54] SPLIT-BODY GOLF BAG

[76] Inventors: Anita Perino, P.O. Box 5087; Craig Hufnagel, P.O. Box 277, both of Southampton, N.Y. 11969

[21] Appl. No.: 09/369,205

[22] Filed: Aug. 6, 1999

[51] Int. Cl.[7] ..... A45F 3/04

[52] U.S. Cl. ..... 224/645; 224/582; 224/627; 224/259; 206/315.3

[58] Field of Search ..... 224/577, 153, 224/581, 582, 583, 627, 645, 653, 259; 190/110; 206/315.2, 315.3, 315.6

[56] References Cited

U.S. PATENT DOCUMENTS

| | | | |
|---|---|---|---|
| D. 291,262 | 8/1987 | Colby . | |
| D. 312,726 | 12/1990 | Kline . | |
| 3,530,919 | 9/1970 | May | 224/583 X |
| 4,350,194 | 9/1982 | Brown | 190/110 X |
| 4,424,841 | 1/1984 | Smith | 224/583 X |
| 4,655,346 | 4/1987 | Reinholz | 206/315.6 |
| 5,042,703 | 8/1991 | Izzo . | |
| 5,348,205 | 9/1994 | Steurer . | |
| 5,402,923 | 4/1995 | Snyder . | |
| 5,419,473 | 5/1995 | Lamar . | |
| 5,472,084 | 12/1995 | Aliano, Jr. | 206/315.3 |
| 5,544,792 | 8/1996 | Arnwine | 224/583 X |
| 5,558,259 | 9/1996 | Izzo . | |
| 5,791,537 | 8/1998 | Miller | 224/583 |
| 5,961,017 | 10/1999 | Mehler | 224/582 X |

FOREIGN PATENT DOCUMENTS

| | | | |
|---|---|---|---|
| 154365 | 12/1991 | Switzerland | 224/153 |
| 398212 | 8/1933 | United Kingdom | 206/315.6 |
| 9118650 | 12/1991 | WIPO | 206/315.3 |

*Primary Examiner*—Gregory M. Vidovich
*Attorney, Agent, or Firm*—Wenderoth, Lind & Ponack, L.L.P.

[57] ABSTRACT

A golf bag assembly adapted to be carried by an operator while operating a two-wheeled vehicle. The golf bag assembly includes a first bag body member forming a first receptacle for receiving golf clubs, and a second bag body member forming a second receptacle for receiving golf clubs. The upper ends of the first and second bag body members are pivotally coupled so that said first and second bag body members can pivot towards and away from each other. A releasable fastener is provided for securing the lower closed ends of the first and second bag body members. The lower ends are detachable in order to permit the first and second body members to pivot away from each other and assume an inverted V-shape so that the bag assembly can be safely transported on a motorcycle.

13 Claims, 6 Drawing Sheets

SPLIT-BODY GOLF BAG

BACKGROUND OF THE INVENTION

1. Field of the Invention

The present invention is directed to a bag for carrying elongated articles and, in particular, to a golf bag designed to permit the bag to be worn by a user while operating a vehicle such as a motorcycle, a bicycle or the like. For convenience, the present invention will described in connection with a motorcycle.

2. Description of the Related Art

The game of golf has experienced an unprecedented increase in the number of men and women who have taken up the sport as a recreational activity. With the increased interest in golf, numerous improvements in the devices used for holding and carrying golf clubs have been developed. However, the improvements in golf bags, which are designed to be carried, are primarily directed to arrangements for making the bag self-standing and to the strap design.

Due to the fact the golf bags are usually designed to be carried across a golfers back or in a vertical orientation with a double shoulder strap arrangement, the known bags are difficult or impossible to transport while the wearer is operating a two wheeled vehicle or any other mode of transportation in which the wearer straddles the seat.

U.S. Pat. No. 5,419,473 discloses a golf bag having a dual shoulder support system which enables the container body to be carried in a stabilized vertical orientation. With the arrangement disclosed in U.S. Pat. No. 5,419,473, the weight of the golf bag is evenly distributed on the user's shoulders, however the bag could not be carried in this orientation while operating a motorcycle.

U.S. Pat. No. 5,348,205 discloses another golf club carry bag having a dual shoulder strap arrangement for supporting a bag body across the back of the user. This golf bag could be worn while operating a motorcycle, however, transporting the bag in this position would create an unacceptably dangerous situation because the weight of the bag will cause an imbalance due to the tendency of the bag to shift and create moment forces about the motorcycle operator. Also, the mere fact that a lower end of the bag would extend laterally outwardly from one side of the motorcycle would pose a significant danger.

Therefore, a need exists to develop a golf bag which will allow the loaded bag to be safely and comfortably worn while operating a motorcycle.

SUMMARY OF THE INVENTION

Accordingly, it is an object of the present invention to provide a bag for carrying golf clubs or other elongated articles which can be easily and safely transported while operating a vehicle such as a motorcycle.

The object of the present invention is achieved by providing a golf bag having a split bag body design. That is, the bag is formed by pivotally connecting first and second container structures so as to allow a "scissor-like" movement of the bag parts. Due to this novel construction, the bag assembly can assume the shape of an inverted V for transportation on a motorcycle. In this position, the lower ends of the first and second container structures extend along opposite sides of the motorcycle when the wearer is seated thereon. Thus, the bag assembly of the present invention is balanced so that the center of gravity of the bag is located in the middle of the wearer's back.

Further, upon dismounting the motorcycle, the bag assembly can be moved into a conventional orientation. In other words, the first and second container structures are rotated towards each other and their lower ends are secured together. In this position, the bag can be worn while in a vertical orientation so that it extends along the length of the wearer's back. In this position the weight of the bag can be evenly distributed on the wearer's shoulders. Alternatively, the bag may be carried by slinging the bag over one shoulder.

This and other objects of the present invention will become more clear from the following detailed description in conjunction with the accompanying drawings, in which:

DETAILED DESCRIPTION OF THE INVENTION

As required, a detailed embodiment of the present invention is disclosed herein, however, it is to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

A golf bag assembly according to a preferred embodiment of the present invention is shown in FIGS. 1–6. The bag assembly includes a first bag body portion 1 and a second bag body portion 2. Each of the bag body portions 1, 2 is a generally semi-cylindrical receptacle having a closed lower end and an open upper end for receiving the shafts of a plurality of golf clubs. Taken together, the two bag body portions should have a club capacity that is sufficient to accommodate at least a full set, i.e. fourteen golf clubs. The interior space defined by the bag body portions 1, 2 may be provided with internal walls or other separators for separating golf clubs contained therein.

Figure 5:
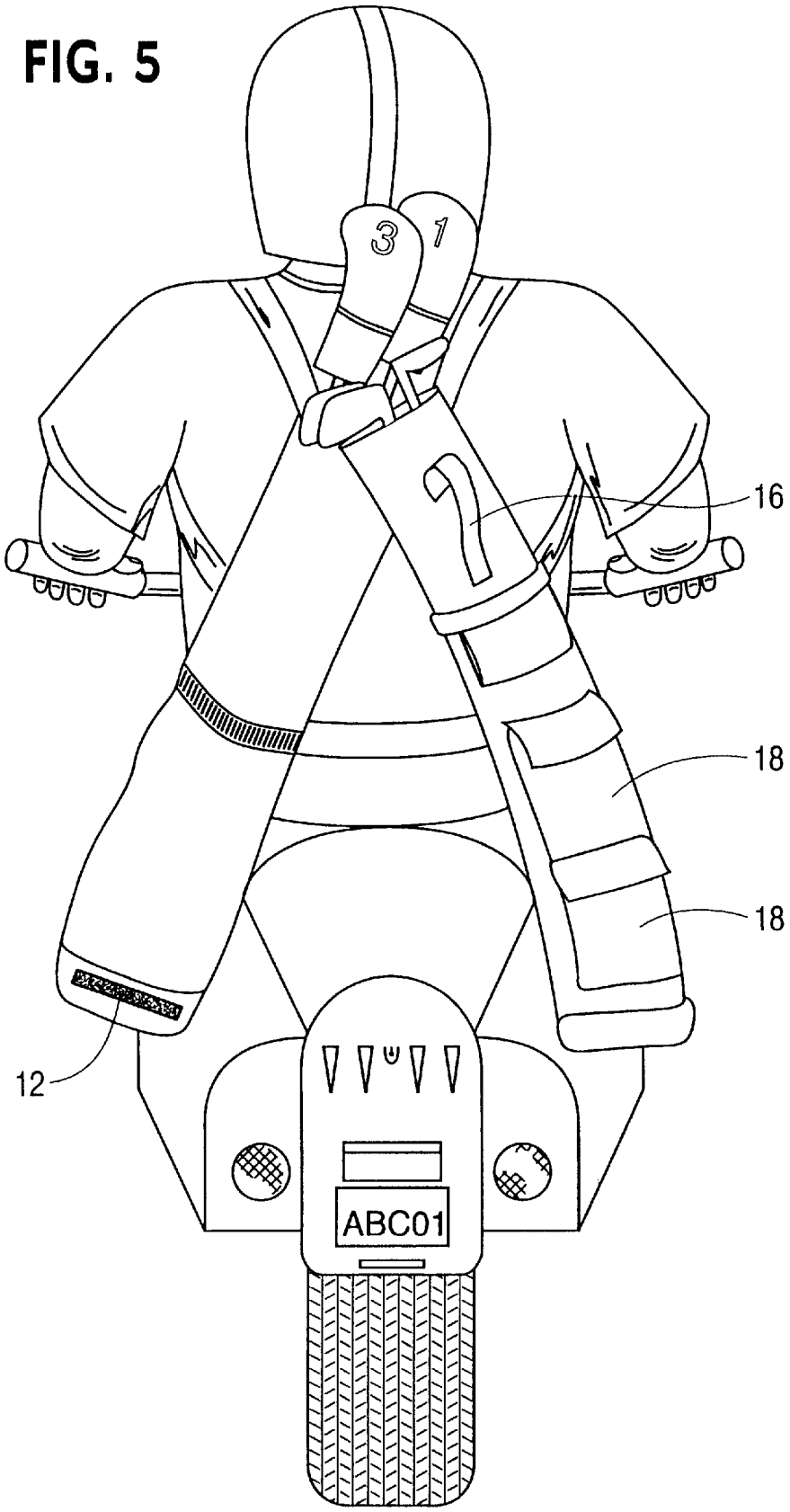
FIG. 5 is a rear view of a user wearing the carry bag of FIG. 1 while operating a motorcycle.

As shown in FIG. 5, at least one of the bag body portions 1, 2 can be provided with a handle 16, e.g. for lifting the bag assembly out of a golf cart. Also, the bag body portions can be provided with accessory pockets 18 for holding items such as golf balls, tees, etc.

The two bag body portions 1, 2 are preferably formed of a durable, lightweight material such as cloth, canvas, nylon or similar materials. Stiffening rods can be provided in the receptacles or the materials can form a covering which encircles a frame formed of a rigid material, such as metal.

Figure 3A:
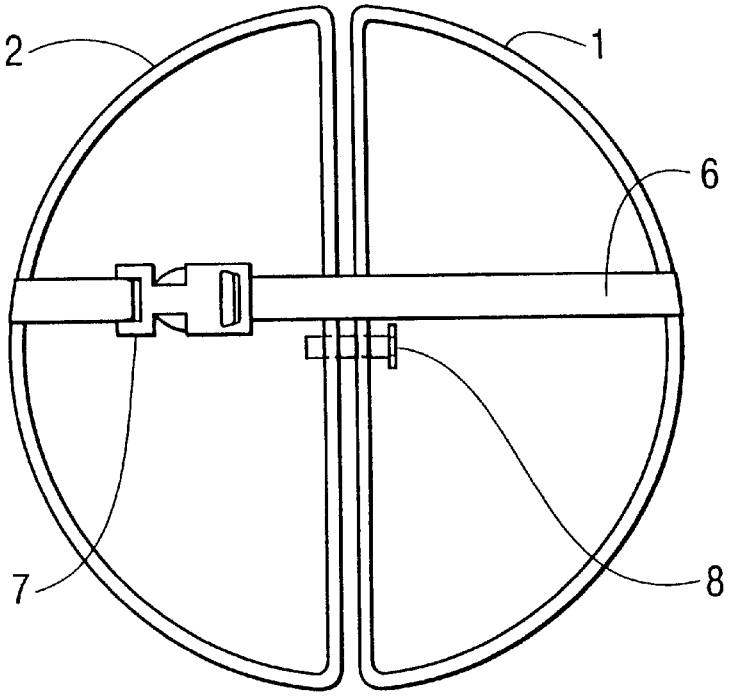
FIG. 3A is in a top plan view of an upper end of the bag assembly shown in FIG. 1.

Each of the bottom ends 1*a*, 2*a* preferably forms a rigid semi-circular base (FIG. 3B), and each of upper ends 1*b*, 2*b* preferably forms a rigid semi-circular rim (FIG. 3A).

Alternatively, each of the bag body portions can be formed of a rigid material or one of the bag body portions could incorporate a bag stand. However, it should be noted that the particular construction of the bag body portions 1, 2 is not critical in the present invention, as any of several constructions may work equally well. Also, the particular construction may be dictated by the intended use, i.e. whether the bag assembly is to be exclusively used as a carry bag, or whether it is to also be supported on a pull cart or in a golf cart.

Figure 1:
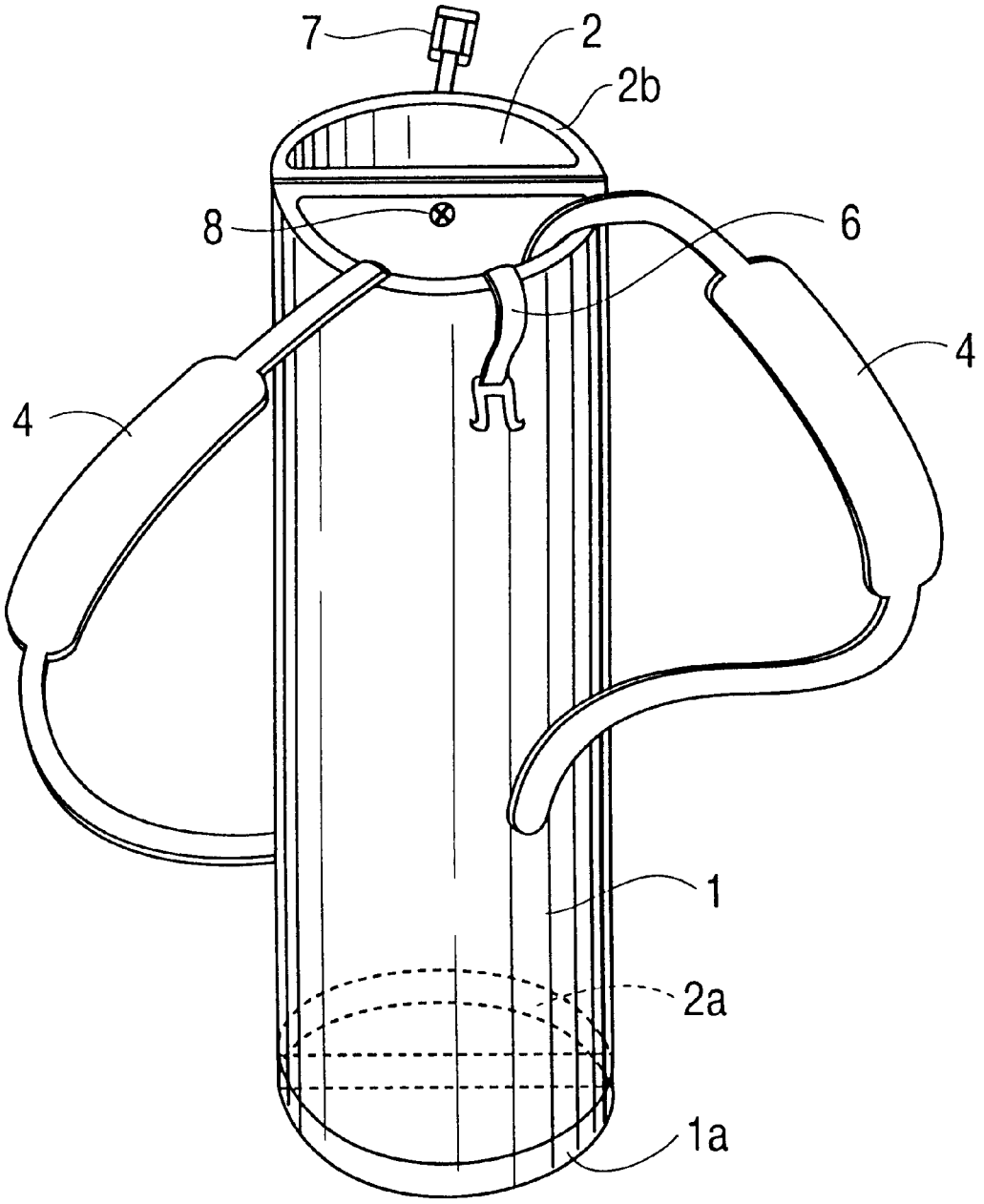
FIG. 1 is a perspective view of an embodiment of a bag assembly constructed in accordance with the present invention.
Figure 2:
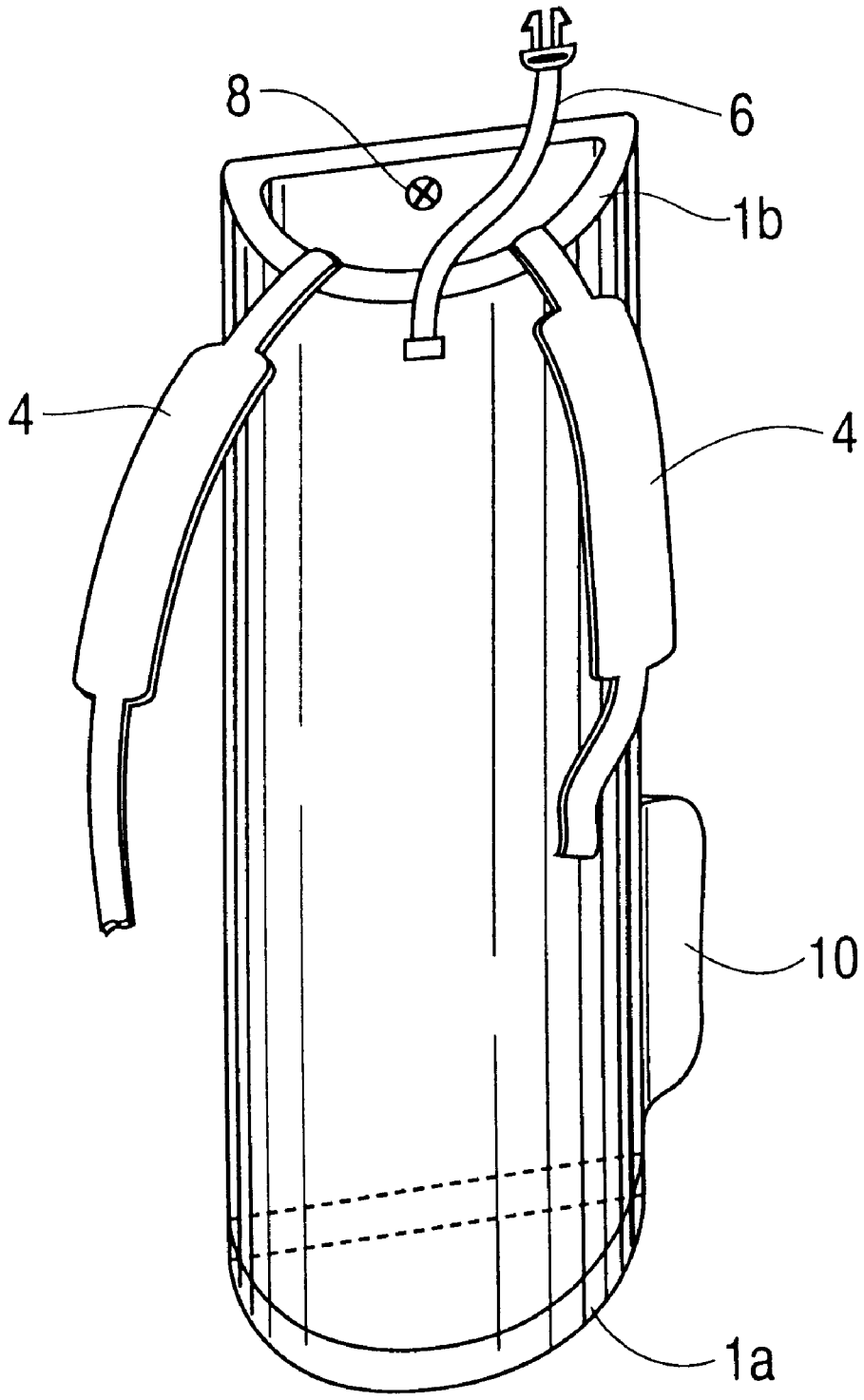
FIG. 2 is perspective view of one component of the bag assembly illustrated in FIG. 1.

As shown in FIG. 1, the bag body portions 1, 2 are aligned and connected in a vertical orientation by connecting the lower ends 1*a*, 2*a* and the upper ends 1*b*, 2*b* of the bag body portions 1, 2. In particular, the upper ends of the bag body portions 1, 2 are pivotally connected so that the bag body portions 1, 2 are able to pivot relative to each other about a connector 8. The connector may be any conventional fastener which will allow the bag body portions to pivot while providing a secure connection between the upper ends. For example, the combination of a bolt, washers, and nut will connect the upper ends 1*b*, 2*b* and allow the bag body portions 1, 2 to pivot about the axis of the bolt. A rivet could also be used.

As best shown in FIG. 3A, an adjustable strap 6 crosses a central portion of the upper ends to provide stability and to function as a club divider. The division of the clubs accommodated in the bag body portions 1, 2 is necessary to provide the necessary balance while riding on a motorcycle. The strap 6 is connected at opposite ends to opposite outer peripheral portions of the upper ends 1*b*, 2*b*. The adjustable strap 6 includes as quick release buckle 7, as shown in FIGS. 1 and 3A.

Figure 3B:
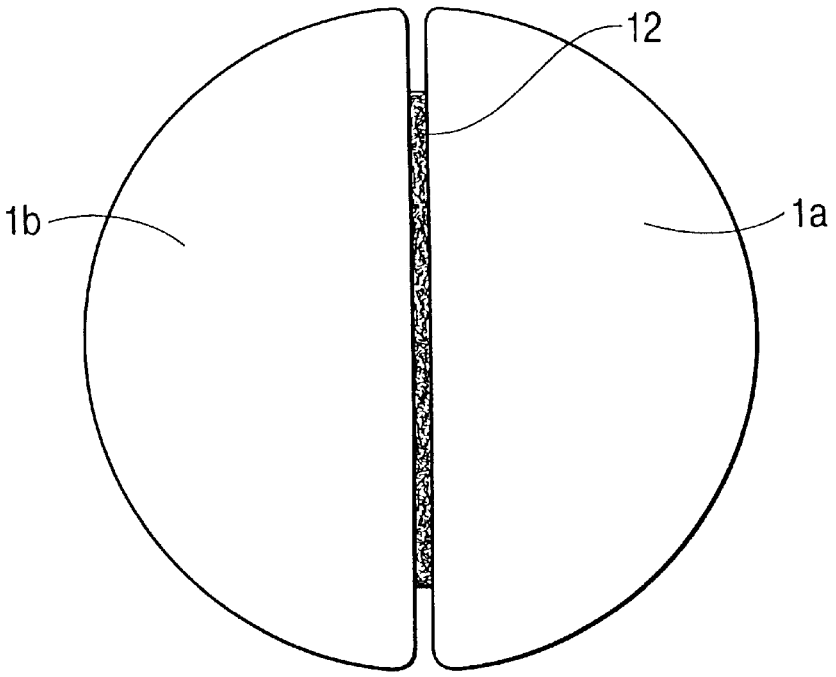
FIG. 3B is a bottom plan view of lower end of the bag assembly shown in FIG. 1.

Further, as shown in FIG. 3B, the lower ends 1*a*, 2*a* of bag body portions 1, 2 are detachably connected together by a hook and loop fastener which is comprised of strips of material 12. The strips of material 12 are provided on opposing surfaces of the lower ends of bag body portions 1, 2 (see FIG. 4). The strips of material are marketed under the trademark VELCRO. However, it should be noted that other fastening devices can be used to connect the bottom portions 1*a*, 2*a*, such as a strap and buckle arrangement.

In the illustrated embodiment, a pair of adjustable shoulder straps 4 are preferably employed to support the bag body on the shoulders of a person wearing the bag. The shoulder straps include a first shoulder strap assembly having a first end secured to an upper portion of the first bag body portion and a second end connected to a lower portion of the first bag body portion and a second shoulder strap assembly having a first end secured to the upper portion of the first bag body portion and a second end connected to a lower portion of the second bag body portion.

Figure 4:
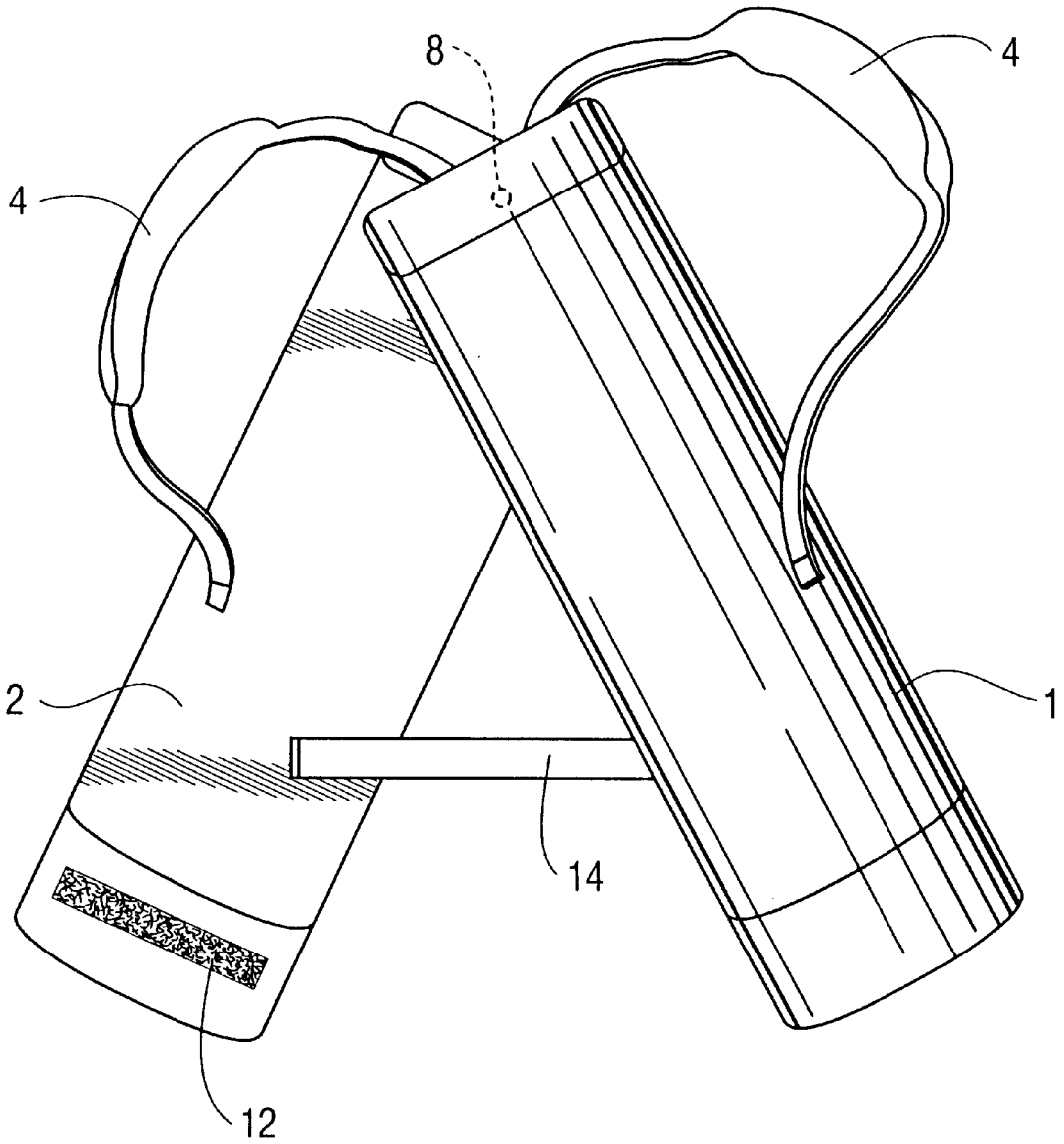
FIG. 4 is a side view of the carry bag shown in FIG. 1 in a position for being worn while operating a motorcycle.

Also, as shown in FIGS. 4 and 5, an elastic tension strap 14 is provided to hold the bag body portions 1, 2 close to the rider and the motorcycle. The strap 14 also functions to stabilize the split body design and to prevent the bag assembly from becoming top heavy by effectively lowering the center of gravity.

Figure 6:
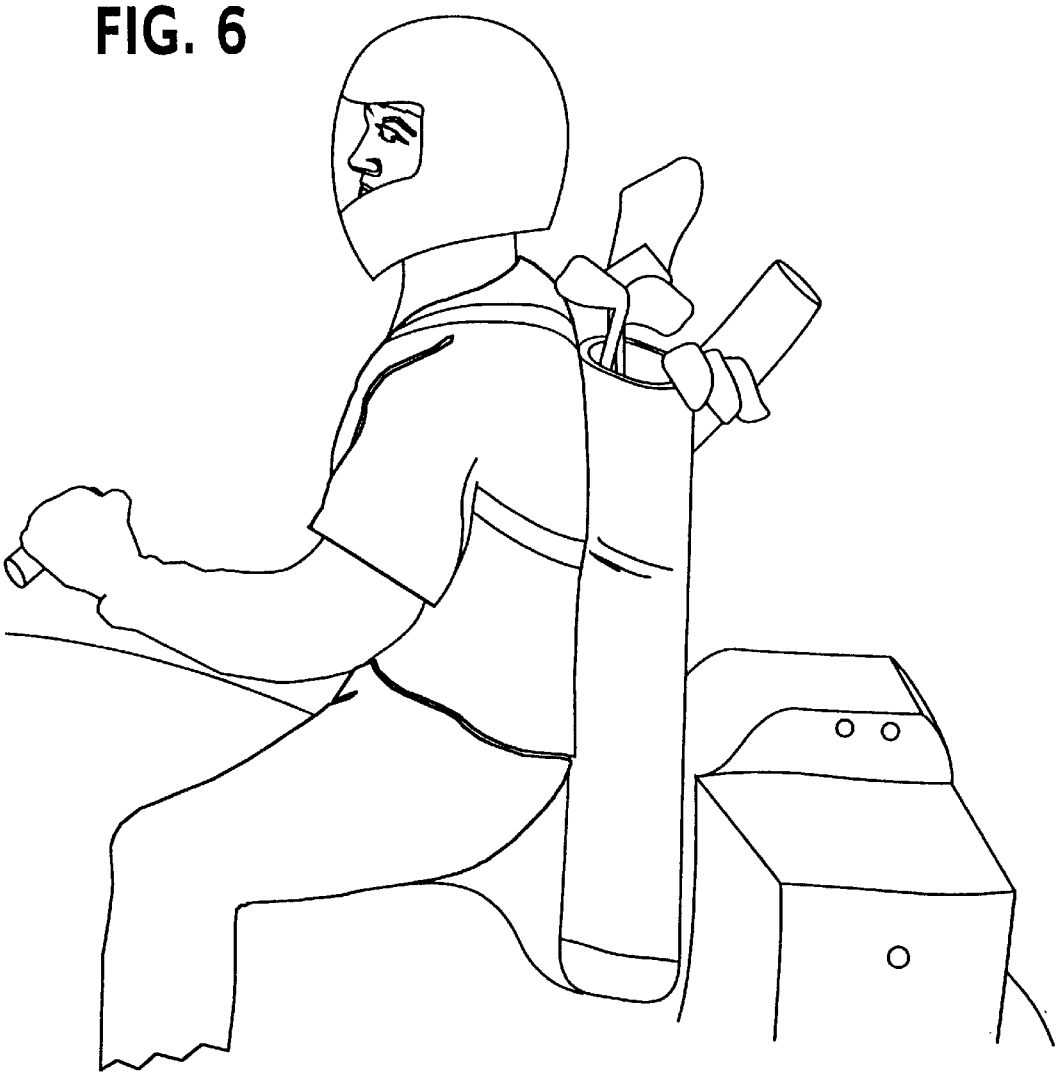
FIG. 6 is a side view showing a user wearing the carry bag of FIG. 1 while operating a motorcycle.

As illustrated in FIGS. 5 and 6, the above-described bag design keeps the club heads safely away from the rider's helmet. Accordingly, the clubs do not interfere with or inhibit the rider's ability to operate the motorcycle. Also, the bag position ensures that the bag will not obstruct any of the mirrors or motorcycle lights.

It should be understood that various changes and modifications to the presently preferred embodiment, described herein, will be apparent to those skilled in the art. Such changes and modifications can be made without departing from the spirit and scope of the present invention and without diminishing its attendant advantages. It is therefore intended that such changes and modifications be covered by the appended claims.

We claim:

1. A golf bag assembly adapted to be carried by an operator while operating a two-wheeled vehicle, said golf bag assembly comprising:

a first bag body member having a lower closed end and an upper open end, said first bag body member forming a receptacle for receiving golf clubs;

a second bag body member having a lower closed end and an upper open end, said second bag body member forming a receptacle for receiving golf clubs, wherein said upper ends of said first and second bag body members are pivotally coupled so that said first and second bag body members can pivot relative to each other;

a support assembly connected to said bag body members for supporting said first and second bag body members on a wearer's shoulders; and a resilient member connected between said first and second bag body members for controlling pivotal movement thereof, wherein upon pivotal movement of said first and second bag body members, said lower ends of said first and second body members move away from each other and assume an inverted V-shape so that said lower ends are spaced from each other to permit the bag assembly to be safely transported on the two wheeled vehicle while being supported on the shoulders of the wearer.

2. A golf bag assembly as claimed in claim 1, wherein said support assembly comprises:

a first shoulder strap assembly having a first end secured to an upper portion of said first bag body member, and a second end connected to a lower portion of said first bag body member; and a second shoulder strap assembly having a first end connected to the upper portion of said first bag body member, and a second end connected to a lower portion of said second bag body member.

3. A golf bag assembly as claimed in claim 1, further comprising a releasable fastener for securing together said lower closed ends of said first and second bag body members.

4. A golf bag assembly as claimed in claim 1, further comprising a divider strap including:

a first strap portion having a first end and a second end connected to an upper portion of said first bag body member;

a second strap portion having a first end and a second end connected to an upper portion of said second bag body member; and a quick release coupling member for releasably interconnecting said first ends of said first and second strap portions, wherein said divider strap extends over a central portion of said upper open ends of said first and second bag body portions when said quick release coupling member connects said first ends of said first and second strap portions.

5. A golf bag assembly as claimed in claim 3, wherein said releasable fastener comprises opposing strips of hook and loop material.

6. A golf bag assembly as claimed in claim 1, wherein each of said first and second bag body members has a semi-cylindrical shape.

7. A golf bag assembly capable of being worn by an operator while the operator is seated on a two-wheeled vehicle, said golf bag assembly comprising:

a first bag body having a lower closed end and an upper open end, said first bag body forming a receptacle for receiving golf clubs;

a second bag body having a lower closed end and an upper open end, said second bag body forming a receptacle for receiving golf clubs, wherein said upper ends of said first and second bag bodies are pivotally coupled so that said first and second bag bodies can pivot relative to each other;

a support assembly connected to said bag bodies for supporting said first and second bag bodies on a wearer's shoulders; and a releasable fastener for securing together said lower closed ends of said first and second bag bodies, wherein, upon release of said fastener and pivotal movement of said first and second bag bodies, said lower ends of said first and second bag bodies are spaced from each other and the bag bodies assumes an inverted V-shape to allow the bag assembly to respectively straddle opposing sides of the two-wheeled vehicle while being supported on the shoulders of the wearer.

8. A golf bag assembly as claimed in claim 7, wherein said support assembly comprises:

a first shoulder strap having a first end secured to an upper portion of said first bag body, and a second end connected to a lower portion of said first bag body; and a second shoulder strap having a first end connected to the upper portion of said first bag body, and a second end connected to a lower portion of said second bag body.

9. A golf bag assembly as claimed in claim 7, further comprising a resilient strap connected between intermediate portions of said first and second bag bodies.

10. A golf bag assembly as claimed in claim 7, further comprising a divider strap including:

a first strap portion having a first end and a second end connected to an upper portion of said first bag body;

a second strap portion having a first end and a second end connected to an upper portion of said second bag body; and a quick release coupling member for releasably interconnecting said first ends of said first and second strap portions, wherein said divider strap extends over a central portion of said upper open ends of said first and second bag bodies when said quick release coupling member connects said first ends of said first and second strap portions.

11. A golf bag assembly as claimed in claim 7, wherein said releasable fastener for securing together said lower closed ends of said first and second bag bodies comprises opposing strips of hook and loop material.

12. A golf bag assembly as claimed in claim 7, wherein each of said first and second bag bodies has a semi-cylindrical shape.

13. A golf bag assembly as claimed in claim 7, wherein said wherein said upper ends of said first and second bag bodies are pivotally coupled with a non-releasable fastener.

* * * * *